US005986628A

United States Patent [19]

Tuenge et al.

[11] Patent Number: 5,986,628

[45] Date of Patent: Nov. 16, 1999

[54] FIELD SEQUENTIAL COLOR AMEL DISPLAY

[75] Inventors: Richard Tuenge, Hillsboro; Terrance Larsson, Sherwood; Steven Wald, Tualatin; Christopher N. King, Portland, all of Oreg.

[73] Assignee: Planar Systems, Inc., Beaverton, Oreg.

[21] Appl. No.: 08/856,140

[22] Filed: May 14, 1997

[51] Int. Cl.[6] ..... G09G 3/30

[52] U.S. Cl. ..... 345/76; 345/72; 345/88; 340/757; 315/169.3

[58] Field of Search ..... 345/76, 65, 77, 345/80–84, 205, 213, 109, 88; 315/169.3; 340/757

[56] References Cited

U.S. PATENT DOCUMENTS

| | | | |
|---|---|---|---|
| 4,019,808 | 4/1977 | Scheffer | 350/160 |
| 4,635,051 | 1/1987 | Bos | 340/757 |
| 4,977,350 | 12/1990 | Tanaka et al. | 313/505 |
| 4,983,469 | 1/1991 | Huzino et al. | 428/690 |
| 5,124,818 | 6/1992 | Conner et al. | 359/53 |
| 5,346,776 | 9/1994 | Taniguchi et al. | 428/690 |
| 5,463,279 | 10/1995 | Khormaei | 315/169.3 |
| 5,469,279 | 11/1995 | Sharp et al. | 359/53 |
| 5,598,059 | 1/1997 | Sun | 313/509 |
| 5,822,021 | 10/1998 | Johnson et al. | 348/742 |

OTHER PUBLICATIONS

Gary D. Sharp and Kristina M. Johnson, "High Brightness Saturated Color Shutter Technology", ColorLink, Inc, pp. 2–4, May 17, 1996.

Robert W. Floyd and Louis Steinberg, "An Adaptive Algorithm for Spatial Greyscale" Proceeding of the S.I.D., vol. 17 2, 1976, pp. 75–77.

R. Khormaei, et al., "42.3: A 1280×1024 Active–Matrix EL Display" SID 95 Digest, 1995, pp. 891–893.

Gary D. Sharp and Kristina M. Johnson, "High Brightness Saturated Color Shutter Technology" ColorLink, Inc., at least as early as 1996.

M. Aguilera, et al., "An RGB Color VGA Active–Matrix EL Display" Planar America, Inc., at least as early as May 1997.

Runar O. Törnqvist, "TFEL Color by White" Planar International Ltd., at least as early as Mar. 1997.

*Primary Examiner*—Richard A. Hjerpe
*Assistant Examiner*—Henry N. Tran
*Attorney, Agent, or Firm*—Chernoff, Vilhauer, McClung & Stenzel LLP

[57] ABSTRACT

A full color active matrix electroluminescent display includes an active matrix of pixel electrodes, a broad spectrum electroluminescent phosphor stack placed atop the active matrix of pixel electrodes and a transparent electrode placed atop the electroluminescent phosphor stack. A liquid crystal color shutter device is placed atop the transparent electrode for selectively filtering light from the electroluminescent phosphor stack selectively permitting the transmission of red, green or blue colored light in response to commands from a synchronizing circuit that synchronizes the operation of the shutter with the illumination of selected pixels in the active matrix display. Performance is further enhanced by the use of a double notch filter for the white light emitting broad spectrum electroluminescent phosphor so as to provide it with a uniform response at all waves lengths of interest.

3 Claims, 3 Drawing Sheets

| CELL 1 | CELL 2 | COLOR | SWITCHING SPEED |
|---|---|---|---|
| 0 | 0 | RED | |
| | | | 50 μSEC |
| 0 | 1 | GREEN | |
| | | | 50 μSEC |
| 1 | 1 | BLUE | |
| | | | 1.7 ms |
| 0 | 0 | RED | |

| | STANDARD FILTER | | SINGLE-NOTCH | | DOUBLE-NOTCH | |
|---|---|---|---|---|---|---|
| COLOR | x | y | x | y | x | y |
| RED | 0.581 | 0.418 | 0.639 | 0.359 | 0.632 | 0.367 |
| GREEN | 0.354 | 0.609 | 0.235 | 0.689 | 0.287 | 0.682 |
| BLUE | 0.102 | 0.266 | 0.089 | 0.264 | 0.166 | 0.147 |

FIELD SEQUENTIAL COLOR AMEL DISPLAY

BACKGROUND OF THE INVENTION

Active matrix electroluminescent (AMEL) display screens are very useful for head mounted and other personal display applications because of their low weight, compact size and ruggedness. Monochrome AMEL displays processed on single crystal silicon on insulator (SOI) substrates have demonstrated high-resolution with high luminescence and reliability in a compact package suitable for personal viewer display applications.

A desirable object of personal viewing devices is the provision of full color. In thin film electroluminescent (TFEL) devices there are several methods of obtaining a full color display. One such method is the use of patterned filters superimposed over a "white" screen to provide the three primary colors. An example of a TFEL screen of this type is shown in Sun, et al., U.S. Pat. No. 5,598,059.

The problem with this type of structure is that each pixel consists of three sub-pixels, each emitting red, green or blue, respectively. This adds greatly to the size and bulk of the display, requires more interconnects to the driving electronics and, accordingly, tradeoffs must be made between resolution and the size of the display. Another problem with white screen and filter architecture is that insufficient blue is provided due to the limited phosphor emission below 470 nanometers and the broad absorption edge of the filter.

The same technique can be accomplished with four active matrix pixels to produce a single color pixel, but the large die area needed for such an array adversely effects the IC process yield display cost. The energy dissipation in such a device is four times greater than an even smaller monochrome display with the same resolution using AMEL architecture.

What is needed, therefore, is a high-resolution, color, AMEL display device which can provide improved color performance, reduced power consumption and low manufacturing cost.

SUMMARY OF THE INVENTION

According to the present invention a full color active matrix EL display includes an active matrix of pixel electrodes, a broad spectrum electroluminescent phosphor stack placed atop the active matrix of pixel electrodes and a liquid crystal color shutter device for selectively filtering light from the EL phosphor stack to produce a full color display.

The display device includes a circuit which synchronizes the active matrix of pixel electrodes with a liquid crystal color shutter device. The circuit synchronously activates selected AMEL pixels and selective combinations of shutter devices to produce red, green and blue light respectively during three sub-frames of video. The combined effect of the three sub-frames for each pixel produces light from that pixel of the requisite color and intensity called for by the video data that the display screen is to produce.

The electroluminescent phosphor stack is a white light producing electroluminescent structure and includes at least one layer of ZnS:Mn and a layer of SrS:Ce. Because the white light produced by the EL phosphor stack has a relative intensity which varies as a function of wavelength, the relative intensity has a peak at at least one wavelength and therefore a notch filter is provided with a notch at the peak wavelength for attenuating the relative intensity of the white light emission. Preferably, a double notch filter is used because the emission spectrum of the ZnS:Mn/SrS:Ce phosphor peaks at both 490 and at 580 nanometers. The double notch filter makes the frequency distribution of the white light phosphor more uniform over the visible spectrum.

A liquid crystal color shutter device is stacked in series with the white light emitting phosphor stack. The color shutter comprises two fast switching nematic LC cells with color polarizers and polarizing filters. There are two filter stages each having blue/yellow and red/cyan polarizers which are tuned to the spectral output of the broad band EL phosphor stack. Because the filter alignment to the AMEL substrate is not critical, this structure provides for a simple manufacturing process.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figures 1, 2:
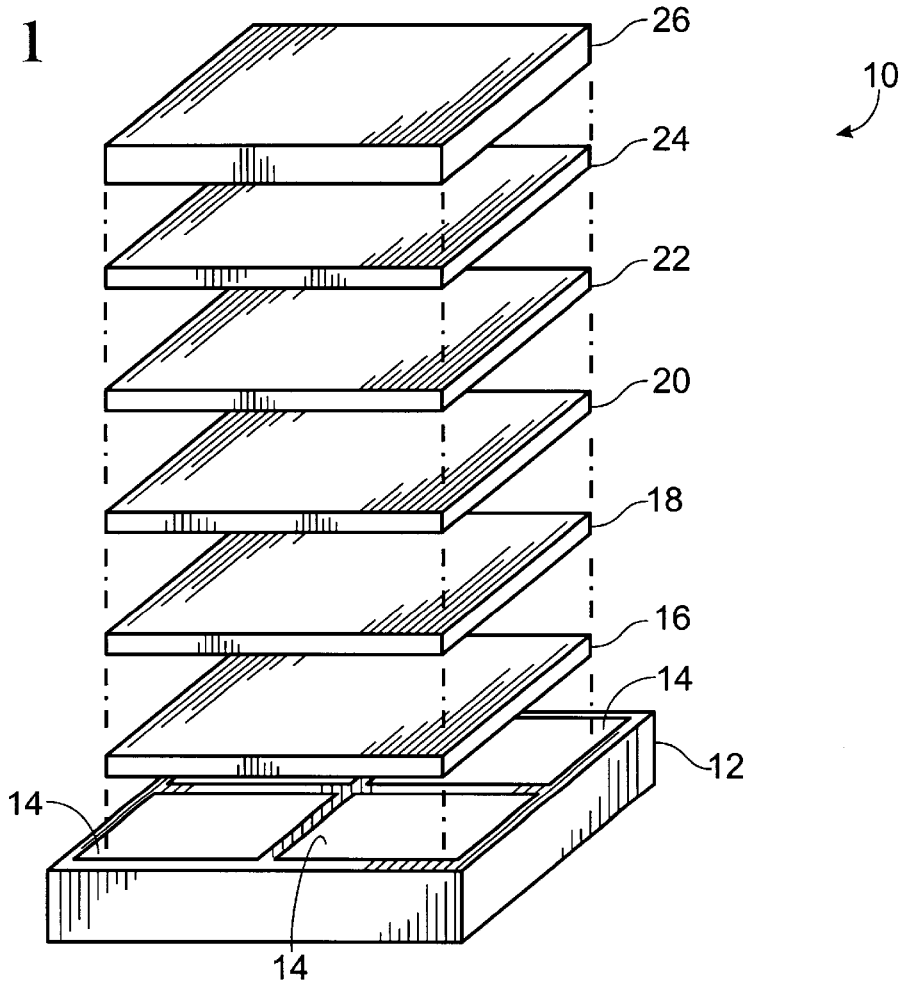
FIG. 1 is an exploded perspective view of an AMEL color display device using an LC color shutter.
FIG. 2 is a truth table for color shutter sequencing.

Referring to FIG. 1, an AMEL color display device 10 includes an SOI AMEL wafer 12. The wafer 12 includes metal electrodes 14. The electrodes 14 are coupled though vias to transistors (not shown) in the wafer 12. A typical AMEL device useful for this application is shown in the U.S. Patent to Khormaei, No. 5,463,279. An insulator 16 is placed atop the metal electrodes 14. Next, an EL phosphor stack 18 comprising SrS:Ce and ZnS:Mn is placed atop the insulator 16. A second insulator 20 is placed atop the EL phosphor stack and a transparent ITO electrode 22 is placed atop the insulator 20. Seal material 24 is placed on top of the ITO electrode 22 and an LC color shutter device 26 is placed atop the seal material 24.

The color shutter device 26 is a high brightness field sequential liquid crystal color shutter, based on color polarization switches as described in a paper by G. D. Sharp and K. M. Johnson, *High Brightness Saturated Color Shutter Technology*, SID 96 Digest p. 411 (1996). This type of shutter is available from ColorLink, Inc. of Boulder, Colo. Other color liquid crystal devices are shown in the following U.S. Pat. Nos.: Sharp, et al. 5,469,279, Scheffer 4,019,808, and Bos 4,635,051.

Figure 6:
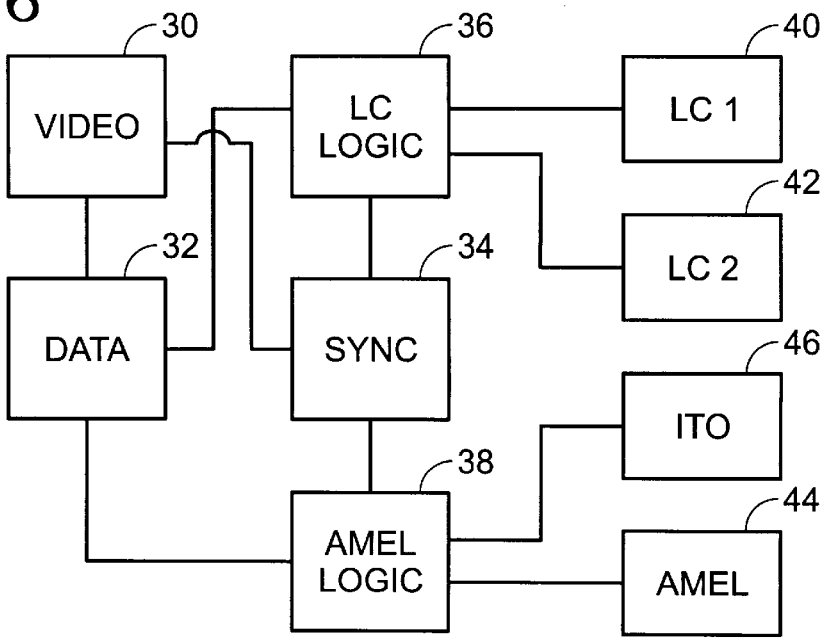
FIG. 6 is a block schematic diagram of an exemplary circuit for producing the wave forms of FIG. 5.

Referring to FIG. 6, a composite video generator 30 provides data to a data register 32 and synchronization to a synchronization register 34. The synchronization register 34 controls the timing of a liquid crystal logic circuit 36 and an AMEL logic circuit 38. The liquid crystal logic circuit 36 controls liquid crystal switches LC1 40 and LC2 42. The AMEL logic circuit 38 controls the AMEL transistor drivers 44 and the ITO electrode 46.

White light is generated from selected pixel points according to a grey scale by the simultaneous energization of pixels through the AMEL drivers 44 and the ITO electrode 46. Color selectivity is provided by the energization of logical combinations of liquid crystal switches LC1 40 and LC2 42.

Figure 5:
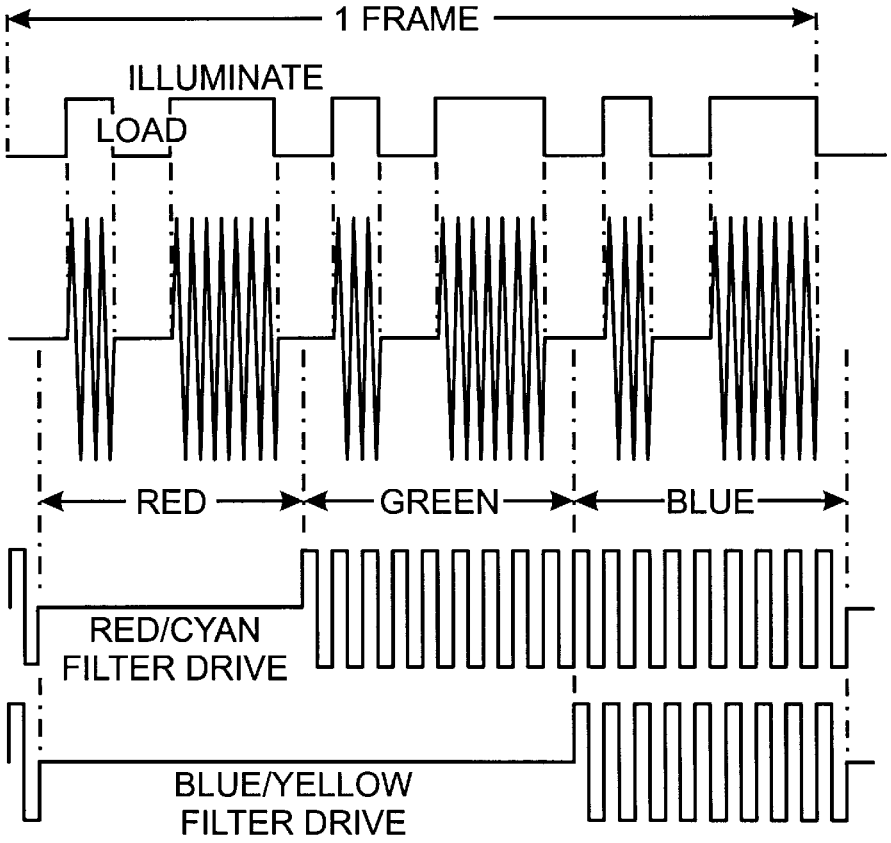
FIG. 5 is a wave form timing diagram showing high-voltage AC and color shutter signals.

A waveform diagram illustrating the operation of the circuit of FIG. 6 is shown in FIG. 5. The LC switch devices 40 and 42 operate as filters when used in conjunction with polarizing devices to selectively permit the transmission of red, green or blue light. The polarizers and liquid crystal devices 40 and 42 are arranged such that the wavelength of light that passes through the filter is determined by the logic states of the liquid crystal devices 40 and 42. The logic states of these devices are shown in FIG. 2 in which cell 1 refers to liquid crystal device 40 and cell 2 refers to liquid crystal device 42. When cell 1 and cell 2 are both in the "off" state red light passes through the filter. When cell 1 is off and cell 2 is on, green light passes through the filter, and when both cell 1 and cell 2 are on only blue light passes through the filter. The speed of the switching logic by the synchronization circuit 34 takes into account the relaxational transition of the blue to red switching state which takes 1.7 ms. The other states only require 50 microseconds. Other mappings of LC state and/or color order may be used to optimize light output or system operation.

As shown in FIG. 5 the operation of the color shutter devices 40 and 42 is synchronized with the illumination of the AMEL display as shown in the top pulsed triangular waveform. This waveform typically has a burst frequency of 4.5 khz and a peak voltage of 190 volts. The shutter sequences through red, green and blue states at a frame rate of 60 cycles. The AMEL logic and the LC logic 38, 36 use a double frame buffer (not shown) to store 6 bits of frame data (2 bits per color) providing 64 colors. Each color is illuminated for 3 cycles with the least significant bit plane and for 7 cycles for the most significant bit plane of that color. The shutter transition from one color to another is done during the time that the display is loaded with new data to avoid inappropriate color illumination. In addition to the temporal grey shade approach, an error diffusion technique as described in a paper by Floyd and Steinberg "An Adaptive Algorithm for Spatial Grey Scale", *Proceedings of the SID*, vol. 7 no. 2 second quarter 1976, may be employed. This spatial grey scale method can increase the number of colors which can be displayed by the color AMEL to 256. Operating either or both LC devices in a partially ON state during off periods may be desirable for color optimization.

Figures 3, 4:
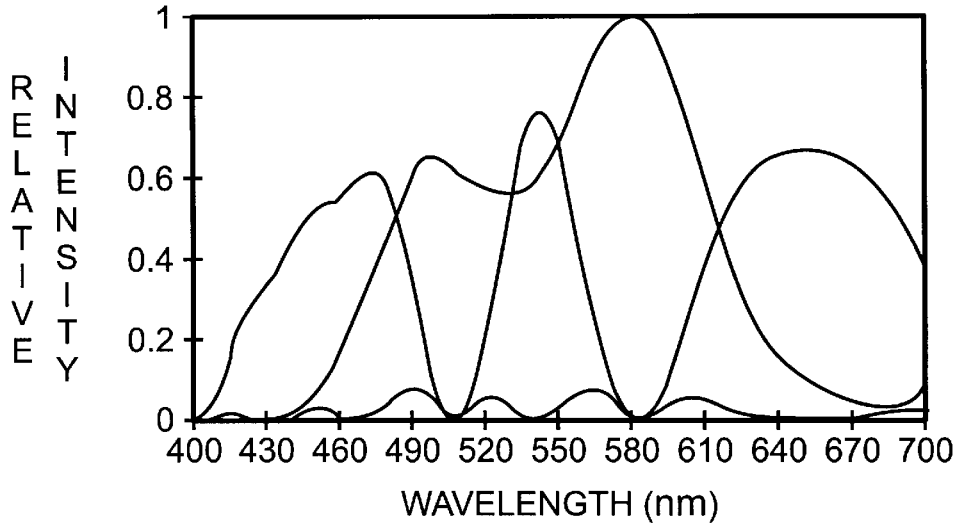
FIG. 3 is a graph showing the output spectrum of a double notch color filter superimposed with the output spectrum of the white screen AMEL phosphor stack.
FIG. 4 is a table showing the calculated CIE coordinates for the screen of FIG. 1.

The SrS:Ce/ZnS:Mn phosphor has more than half of the total power contained in the 550 to 600 nanometer band with insignificant power below 450 nanometers. Consequently, a significant amount of the total power must be rejected in order to achieve color balance and improve the blue and red color coordinates. The relatively high emission in the yellow also requires that the phosphor be filtered in order to have a high dynamic range. A passive filter in the form a notch filter, either a single notch filter with a center wavelength at 580 nanometers, or a double notch or "W" filter with notches at 510 and 587 nanometers, may be used in conjunction with the LC color shutter. As shown in FIG. 3 a W filter provides a substantially flat profile throughout the blue and red with a 40 nanometer green bandwidth centered at about 545 nanometers. FIG. 3 shows the RGB color output spectra of the double notch filter superimposed with the emission spectrum of the white phosphor excited using a 4.5 khz waveform.

As shown in FIG. 4 the use of either a single notch or a double notch filter greatly improves the color coordinates for the white phosphor, in particular, the blue coordinates using the double notch filter provide a deep saturated blue. It should be noted, however, that improvements in "white" light generating EL phosphors may in the future make the use of such filters unnecessary.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

We claim:

1. A full color active matrix electroluminescent display comprising:

a) a matrix of active thin film electroluminescent (TFEL) pixel electrodes;

b) a broad band white light emitting phosphor material placed atop the matrix of active TFEL pixel electrodes;

c) a transparent electrode placed atop the phosphor material;

d) a liquid crystal color shutter device having at least three logic states for transmitting selected primary colors during three subframes of video; and e) a synchronizing circuit for synchronizing the energization of selected pixel electrodes in said matrix with said liquid crystal color shutter device to produce frames of video at a predetermined frame repetition rate, each frame of video comprising three subframes of video wherein during a first subframe of video red light is transmitted, during a second subframe of video green light is transmitted and during a third subframe of video blue light is transmitted.

2. The full color active matrix TFEL display of claim 1 further including a notch filter having at least one notch at a wave length of high intensity light emission produced by the broad band white light emitting phosphor material so as to provide a substantially flat profile of the frequency spectrum of light emitted by the white light emitting phosphor.

3. The full color active matrix TFEL of claim 2 wherein said phosphor material is ZnS:Mn/SrS:Ce and said notch filter has a notch at each one of a pair of wavelengths of high intensity light emission from said phosphor material.

* * * * *